US009976234B2

(12) United States Patent
Park et al.

(10) Patent No.: US 9,976,234 B2
(45) Date of Patent: May 22, 2018

(54) METHOD OF DRY-SPINNING PARA-ARAMID FIBER

(71) Applicant: KOLON INDUSTRIES, INC., Gwacheon-si, Gyeonggi-do (KR)

(72) Inventors: Tae Hak Park, Yongin-si (KR); Bum Hoon Lee, Yongin-si (KR); Jae Young Lee, Yongin-si (KR); Young Cheol Park, Yongin-si (KR); Kyeong Hwan Rho, Yongin-si (KR)

(73) Assignee: KOLON INDUSTRIES, INC., Gwacheon-Si (KR)

( * ) Notice: Subject to any disclaimer, the term of this patent is extended or adjusted under 35 U.S.C. 154(b) by 302 days.

(21) Appl. No.: 14/758,165

(22) PCT Filed: Dec. 19, 2013

(86) PCT No.: PCT/KR2013/011847

§ 371 (c)(1),
(2) Date: Jun. 26, 2015

(87) PCT Pub. No.: WO2014/104648

PCT Pub. Date: Jul. 3, 2014

(65) Prior Publication Data

US 2015/0354093 A1 Dec. 10, 2015

(30) Foreign Application Priority Data

Dec. 28, 2012 (KR) ..... 10-2012-0156804

(51) Int. Cl.

| | |
|---|---|
| ***C08L 77/10*** | (2006.01) |
| ***D01D 5/16*** | (2006.01) |
| ***D01D 10/02*** | (2006.01) |
| ***D02J 1/22*** | (2006.01) |
| ***D02J 13/00*** | (2006.01) |
| ***D01D 5/04*** | (2006.01) |
| ***D01D 10/06*** | (2006.01) |
| ***D01D 5/12*** | (2006.01) |
| ***D01F 6/80*** | (2006.01) |
| ***D01F 11/08*** | (2006.01) |

(52) U.S. Cl.

CPC ..... *D01D 5/04* (2013.01); *D01D 5/12* (2013.01); *D01D 10/06* (2013.01); *D01F 6/805* (2013.01); *D01F 11/08* (2013.01); *D10B 2331/021* (2013.01)

(58) Field of Classification Search

CPC . C08L 77/10; D01D 5/04; D01D 5/12; D01D 5/16; D01D 10/02; D01D 10/06; D01F 6/605; D01F 6/805; D02J 1/22; D02J 13/00

USPC ..... 264/204, 205, 210.8, 211.14, 211.15, 264/211.16, 211.17, 232, 233

See application file for complete search history.

(56) References Cited

U.S. PATENT DOCUMENTS

| | | | | |
|---|---|---|---|---|
| 3,888,821 | A * | 6/1975 | Milford, Jr. ..... | D01F 6/605 264/182 |
| 2009/0160080 | A1 | 6/2009 | Headinger et al. | |
| 2009/0239052 | A1 | 9/2009 | Marumoto et al. | |

FOREIGN PATENT DOCUMENTS

| | | | |
|---|---|---|---|
| EP | 0 572 002 | B1 | 8/2000 |
| KR | 10-2010-0001784 | A | 1/2010 |
| KR | 10-2012-0066182 | A | 6/2012 |
| WO | WO 2009/145446 | A1 | 12/2009 |

* cited by examiner

*Primary Examiner* — Leo B Tentoni

(74) *Attorney, Agent, or Firm* — Birch, Stewart, Kolasch & Birch, LLP

(57) ABSTRACT

The present invention provides a method for manufacturing para-aramid fibers, which includes: spinning a polymeric solution containing aramid polymer in an organic solvent through a spinneret into an inert gas to partially remove the organic solvent contained in the spun fiber; contacting the spun fiber with conditioning solution, so as to maintain residual water in fiber in a range of 10 to 15%; and subjecting the treated fiber to drawing, washing and heating in a dry-spinning manner. The present invention may greatly reduce energy consumption and costs for recovery of the solvent, as compared to a conventional manufacturing method of aramid fiber in a wet-spinning manner. Further, the present invention may solve conventional problems such as corrosion of apparatus, deterioration of working environments, or the like, since a concentrated sulfuric acid solvent is not used in a spinning process. Still further, the present invention may conduct drawing and heating after maintaining the residual water in fiber in a range of 10 to 15% before drawing, thereby remarkably improving the strength and elastic modulus of the fiber.

3 Claims, No Drawings

METHOD OF DRY-SPINNING PARA-ARAMID FIBER

TECHNICAL FIELD

The present invention relates to a method of dry-spinning para-aramid fiber, and more particularly, to a dry-spinning method of para-aramid fiber by manufacturing the para-aramid fiber through a dry-spinning manner so that a solvent may be easily recovered and strength and elastic modulus of a fiber may be remarkably improved.

BACKGROUND ART

Aromatic aramid commonly called aramid includes para-aramid with a structure of benzene rings straightly linked through amide group (CONH) and meta-aramid without the same.

The para-aramid has high strength, high elasticity and low shrinkage or the like. Since a fine thread or string having a thickness of about 5 mm fabricated using the para-aramid has an extremely high strength enough to lift up an automobile of about 2 tons in weight, it is used for bombproof applications and further employed in various uses in high-technology industries in the field of aerospace industry.

The para-aramid is carbonized to become black at a temperature of 500° C. or higher, thus being highlighted in specific applications with a necessity of high thermal resistance.

A method of manufacturing para-aramid fiber has been described well in Korean Patent Registration No. 10-0910537 owned by the present applicant. According to the registered patent, an aramid polymer is prepared by dissolving aromatic diamine in a polymerization solvent to prepare a mixed solution and adding aromatic diacid thereto. After dissolving the aramid polymer in a sulfuric acid solvent to form a spin dope and spinning the same, coagulation, washing and drying are sequentially conducted to finally manufacture the aramid fiber.

However, according to the method of manufacturing the para-aramid fiber by the foregoing processes, the spin dope is formed by firstly preparing a solid para-aramid polymer and dissolving it in a sulfuric acid solvent, and then, subjected to spinning. Accordingly, the foregoing method needs relatively complicated processes, is harmful to health, and problems such as a decrease in durability due to corrosion of apparatus may be entailed.

Further, the sulfuric acid solvent used to dissolve the para-aramid polymer having a high chemical resistance and removed after spinning causes environmental pollution, therefore, must be appropriately treated after use. However, costs necessary for treatment of sulfuric acid waste may result in deterioration of economic efficiency.

Furthermore, according to the above related art, a spin dope formed by dissolving a para-aramid polymer in a sulfuric acid solvent is spun in a fibrous form through a spinneret, and the spun fiber is processed in a wet spinning manner such that the fiber passes through an air gap, followed by passing through a coagulant solution in a coagulation bath. Consequently, there is still a problem of requiring a great amount of energy and huge costs.

DISCLOSURE OF INVENTION

Technical Problem

Accordingly, in order to solve the foregoing problems, an object of the present invention is to provide a dry-spinning method of para-aramid fiber with advantages in that: an organic solvent used for polymerization and spinning processes of the para-aramid fiber can be easily recovered at a low cost; concentrated sulfuric acid is not used during spinning process to thus prevent corrosion of apparatus and other problems such as deterioration of working environments due to the concentrated sulfuric acid; and strength and elastic modulus of the fiber may be remarkably improved.

Solution to Problem

In order to accomplish the foregoing objects, the present invention provides a method for manufacturing para-aramid fibers, which includes: spinning a polymeric solution containing aramid polymer in an organic solvent through a spinneret into an inert gas to partially remove the organic solvent contained in the spun fiber; contacting the spun fiber with a conditioning solution, so as to maintain residual water in fiber in a range of 10 to 15%; and subjecting the treated fiber to drawing, washing and heating in a dry-spinning manner.

Advantageous Effects of Invention

The present invention may greatly reduce energy consumption and costs for recovery of the solvent, as compared to a conventional manufacturing method of para-aramid fiber in a wet-spinning manner.

Further, the present invention may solve conventional problems such as corrosion of apparatus, deterioration of working environments, or the like, since a concentrated sulfuric acid solvent is not used in a spinning process.

Still further, the present invention may conduct drawing and heating after maintaining the residual water in fiber in a range of 10 to 15% before drawing, thereby remarkably improving the strength and elastic modulus of the fiber.

BEST MODE FOR CARRYING OUT THE INVENTION

Hereinafter, the present invention will be described in more detail.

A method of dry-spinning aramid fiber according to the present invention, includes: (i) spinning a polymeric solution, which includes an aramid copolymer having a repeat unit represented by the following Formula I dissolved in an organic solvent, through a spinneret in a fibrous form; (ii) passing the spun fiber into an inert gas to remove a part of the polymerization solvent remained in the fiber; (iii) contacting the fiber which has passed through the inert gas with a conditioning solution which contains an organic solvent and inorganic salt so as to maintain residual water in fiber in a range of 10 to 15%; and (iv) drawing, washing, drying and heating the fiber in contact with the conditioning solution.

Specifically, according to the present invention, a polymeric solution, which includes a para-aramid copolymer having a repeat unit represented by the following Formula 1 dissolved in an organic solvent, is spun through a spinneret in a fibrous form.

[Formula 1]

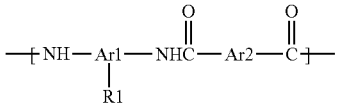

Wherein $R_1$ is —CN, —Cl, —$SO_3H$ or —$CF_3$, and $Ar_1$ and $Ar_2$ are independently each aromatic hydrocarbon having 1 to 4 benzene rings.

The polymeric solution of the present invention may be prepared according to the following processes.

Preparation of Polymeric Solution

Firstly, inorganic salt was dissolved in an organic solvent.

The organic solvent used herein may include amide organic solvents, urea organic solvents, or combined organic solvents thereof. Particular examples of the organic solvent may include N-methyl-2-pyrrolidone (NMP), N,N-dimethylacetamide (DMAc), hexamethylphosphoamide (HMPA), N,N,N',N'-tetramethylurea (TMU), N,N-dimethylformamide (DMF), or a mixture thereof.

The inorganic salt is added to increase a degree of polymerization of aromatic polyamide and may include, for example, halogenated alkali-metal salts or halogenated alkali-earth metal salts such as $CaCl_2$, LiCl, NaCl, KCl, LiBr, KBr, or the like. Such inorganic salts may be used alone or in combination of two or more thereof.

Subsequently, non-substituted aromatic diamine selected from a group consisting of para-phenylenediamine, 4,4'-diaminodiphenyl, 2,6-naphthalenediamine, 1,5-naphthalenediamine and 4,4'-diaminobenzanilide was dissolved in an organic solvent containing inorganic salt added thereto. At the same time, substituted aromatic diamine wherein hydrogen in a benzene ring of the aromatic diamine is substituted by CN, —Cl, —$SO_3H$ or $CF_3$, was dissolved in the organic solvent containing inorganic salt added thereto. The substituted aromatic diamine and non-substituted aromatic diamine dissolved in the organic solvent containing the inorganic salt may be present in a relative molar ratio ranging from 9:1 to 1:9.

Following this, aromatic diacid halide was added to the organic solvent in at least the same molar amount as of the aromatic diamine, thus preparing the polymeric solution. The aromatic diacid halide may be terephthaloyl dichloride, 4,4'-benzoyl dichloride, 2,6-naphthalene dicarboxylic acid dichloride or 1,5-naphthalene dicarboxylic acid dichloride. According to one embodiment of the present invention, the aromatic diacid halide may be terephthaloyl dichloride.

Next, the spun fiber was passed into an inert gas to remove a part of the polymerization solvent remained in the fiber.

Then, the fiber which has passed through the inert gas was contacted with a conditioning solution which contains inorganic salt and an organic solvent, thereby maintaining the residual water in fiber in a range of 10 to 15%.

The conditioning solution may contain 5 to 40 wt. % of organic solvent and 1 to 10 wt. % of inorganic salt, and preferably, have a temperature of 30 to 100° C.

Herein, the conditioning solution is preferably injected to the spun fiber to be in contact with the same.

By contacting the spun fiber with the conditioning solution to maintain the residual water in fiber in a range of 10 to 15%, cut-off of the spun fiber during drawing as a following process may be effectively prevented while improving the strength and elastic modulus of the fiber.

If the residual water in fiber is out of the foregoing range, the fiber does not have desirably improved strength and elastic modulus even after completing following processes such as drawing and heating.

Subsequently, the fiber in contact with the conditioning solution may be subjected to drawing, washing, drying and heating in a dry-spinning manner, thereby manufacturing the para-aramid fiber.

Hereinafter, the present invention will be more clearly understood by the following examples and comparative examples. However, these examples are proposed for concretely explaining the present invention, while not limiting the scope of the present invention to be protected.

Example 1

After providing an organic solvent, that is, N-methyl-2-pyrrolidone (NMP) containing 3 wt. % of $CaCl_2$ in a reactor under a nitrogen atmosphere, 50 mol % of p-phenylenediamine and 50 mol % of cyano-p-phenylenediamine were added to the reactor then dissolved to prepare a mixed solution.

Then, 100 mol % of terephthaloyl dichloride was added to the reactor filled with the mixed solution, to prepare a polymeric solution containing aramid polymer.

Next, by adding CaO as an alkaline compound to the polymeric solution, hydrochloric acid produced during polymerization was neutralized while removing generated water under vacuum.

After then, the polymeric solution containing the aramid polymer was heated and an amount of the organic solvent was regulated to control a concentration of the aramid polymer to about 16 wt. %.

Subsequently, after spinning the polymeric solution through a spinneret in a fibrous form, the spun fiber passed through a nitrogen gas as an inert gas in order to evaporate and remove about 50% of polymerization solvent remained in the fiber, and then, a water-soluble conditioning solution, which contains 30 wt. % of N-methyl-2-pyrrolidone organic solvent and 5 wt. % of $CaCl_2$ inorganic salt and has a temperature of 40° C., was injected to the fiber which has passed through the nitrogen gas to be in contact with the same, thus maintaining the residual water in fiber of about 13%. Continuously, the fiber in contact with the conditioning solution was subjected to drawing in a draw ratio of 4.0, washing, drying and heating, thereby manufacturing the para-aramid fiber.

Results of measuring the strength and elastic modulus of the manufactured para-aramid fiber are shown in Table 2.

Examples 2 to 4 and Comparative Examples 1 to 4

Except that the residual water in fiber and draw ratio after contacting the fiber with the conditioning solution were altered as shown in Table 1, the same procedures as described in Example 1 were executed to manufacture the para-aramid fiber.

Results of measuring the strength and elastic modulus of the manufactured para-aramid fiber are shown in Table 2.

TABLE 1

| Conditions of manufacturing | | |
|---|---|---|
| Section | Residual water (%) | Draw ratio |
| Example 1 | 13 | 4 |
| Example 2 | 10 | 2 |
| Example 3 | 12 | 3 |
| Example 4 | 14 | 5 |
| Comparative Example 1 | 8 | 4 |
| Comparative Example 2 | 7 | 2 |
| Comparative Example 3 | 18 | 4 |
| Comparative Example 4 | 22 | 4 |

TABLE 2

| Results of evaluation of physical properties | | |
|---|---|---|
| Section | Strength (g/d) | Elastic modulus (g/d) |
| Example 1 | 25.4 | 780 |
| Example 2 | 23.7 | 750 |
| Example 3 | 26.2 | 820 |
| Example 4 | 27.7 | 850 |
| Comparative Example 1 | 21.5 | 650 |
| Comparative Example 2 | 20.7 | 550 |
| Comparative Example 3 | 22.3 | 650 |
| Comparative Example 4 | 21.4 | 580 |

INDUSTRIAL APPLICABILITY

The present invention may be applied to manufacturing of para-aramid with improved strength and elastic modulus according to a dry-spinning process.

The invention claimed is:

1. A method of dry-spinning para-aramid fiber, comprising:

(i) spinning a polymeric solution, which includes an aramid copolymer having a repeat unit represented by the following Formula I dissolved in an organic solvent, through a spinneret in a fibrous form;

(ii) passing the spun fiber into an inert gas to remove a part of the polymerization solvent remained in the fiber;

(iii) contacting the fiber which has passed through the inert gas with a conditioning solution which contains an organic solvent and inorganic salt, so as to maintain residual water in fiber in a range of 10 to 15%; and (iv) drawing, washing, drying and heating the fiber in contact with the conditioning solution:

[Formula 1]

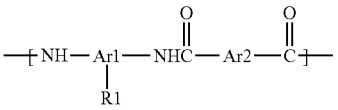

Wherein $R_1$ is —CN, —Cl, —$SO_3H$ or —$CF_3$, and $Ar_1$ and $Ar_2$ are independently each aromatic hydrocarbon having 1 to 4 benzene rings.

2. The method according to claim 1, wherein the conditioning solution is injected to the fiber which has passed through the inert gas to be in contact with the same.

3. The method according to claim 1, wherein the conditioning solution contains 5 to 40 wt. % of organic solvent and 1 to 10 wt. % of inorganic salt, and has a temperature of 30 to 100° C.

* * * * *